US006016850A

United States Patent [19]

Zimmermann et al.

[11] Patent Number: 6,016,850

[45] Date of Patent: Jan. 25, 2000

[54] CONTROLLED WARP TENSIONING DURING FABRIC WEAVING

[75] Inventors: Ewald Zimmermann, Meerbusch; Herbert Mueller, Kressbronn; Martin Eberle, Weissensberg, all of Germany

[73] Assignee: Lindauer Dornier GmbH, Lindua, Germany

[21] Appl. No.: 09/134,357

[22] Filed: Aug. 14, 1998

[30] Foreign Application Priority Data

Aug. 14, 1997 [DE] Germany ..... 197 35 167

[51] Int. Cl.[7] ..... D03D 49/12; D02H 13/26

[52] U.S. Cl. ..... 139/97; 28/194; 242/131.1

[58] Field of Search ..... 139/97, 99; 152/556; 28/193, 194; 242/131.1

[56] References Cited

U.S. PATENT DOCUMENTS

| | | | |
|---|---|---|---|
| 3,550,827 | 12/1970 | Timble | 226/25 |
| 3,828,827 | 8/1974 | Witt et al. | 139/99 |
| 4,019,700 | 4/1977 | King | 242/131.1 |
| 4,941,240 | 7/1990 | Denzler et al. | 28/187 |
| 5,372,164 | 12/1994 | Cloer | 139/97 |
| 5,775,622 | 7/1998 | Jurgens et al. | 242/413.5 |

FOREIGN PATENT DOCUMENTS

| | | |
|---|---|---|
| 0 389 445 | 9/1990 | European Pat. Off. . |
| 0 577 550 | 1/1994 | European Pat. Off. . |
| 1 189 029 | 11/1956 | Germany . |
| 2 260 607 | 6/1974 | Germany . |
| 25 25 764 | 12/1976 | Germany . |
| 35 32 798 | 4/1986 | Germany . |
| 86 90 097 | 6/1992 | Germany . |
| 659 669 | 2/1987 | Switzerland . |
| 668 997 | 2/1989 | Switzerland . |

OTHER PUBLICATIONS

Dipl.—Ing. M. Mchelitsch, "Die Herstelung von Reifenkordgeweben auf Kordwebanlagen", Melliand, 40, Feb. 1959, pp. 145–147 No Translation.

*Primary Examiner*—Andy Falik

*Attorney, Agent, or Firm*—Evenson, McKeown, Edwards & Lenahan, P.L.L.C.

[57] ABSTRACT

In the event of an interruption of the weaving process and in the case of weaving-technical operations, such as tabby weaving and unraveling, a trailing of warp thread bobbins and thus a trailing of warp threads which are withdrawn from the bobbins and form a warp thread family, cannot be avoided without significant expenditures. The trailing results in a so-called trailing length in the thread family which, unless it is correspondingly taken up and correspondingly released during the new start of the weaving process, results in an overstretching of the warp thread family during a starting operation of the bobbins. This disadvantage is avoided by deflecting the thread family within a feeding stand, in the event of a weaving stop, in a controlled manner from a reference plane into at least one defined position. At the new start of the weaving process, the deflection is eliminated in a controlled manner.

19 Claims, 2 Drawing Sheets

CONTROLLED WARP TENSIONING DURING FABRIC WEAVING

BACKGROUND OF THE INVENTION

This application claims the priority of German patent 197 35 167.0-26, filed Aug. 14, 1997, the disclosure of which is expressly incorporated by reference herein.

Process and apparatus for manufacturing woven fabrics, particularly tire cord, are known, for example, from the applicant's previous weaving systems.

A special characteristic of the known systems is that a separate device, called a feeding stand, is arranged between the mechanical weaving loom and at least one bobbin creel having a plurality of rotatably disposed bobbins which have a self-braking effect or are directly actively braked. In the feeding stand, among other things, a compensating device is integrated whose object is to provide a length compensation in the warp thread family and, in the case of a relatively high withdrawal speed of the warp threads from the warp thread bobbins during a new start of the mechanical weaving loom, temporarily compensate for the rotational difference between the initial and the working rotation of the bobbins in the bobbin creel.

During a weaving loom stop, a spring-loaded compensating device, which is inserted between two rollers arranged axially in parallel and spaced from one another, has the effect that the warp thread family is deflected; that is, the trailing length of the warp thread family resulting from the moment of inertia of the rotating warp thread bobbins is taken up by the deflection by means of the compensating shaft relative to a reference plane of the warp thread family.

At the time of a new start of the weaving loom, the deflected trailing length is spring-elastically released so that an abrupt starting of the warp thread bobbins and, in connection therewith, an overstretching of the warp thread family is more or less avoided.

From the above-described process sequence for taking up and releasing the trailing length, it becomes clear that even a compensating shaft loaded by tension springs can react only by mean of empirical experimental values to the slowing-down rotation of the bobbins resulting from the weaving stop or from weaving-technical operations. For example, in the case of heavy, fully wound bobbins and at a high weaving speed, the reaction of the spring-loaded compensating shaft to the warp thread family therefore does not meet the demands made on it.

SUMMARY OF THE INVENTION

It is an object of the invention to improve a process for manufacturing woven fabric, particularly cord wovens for pneumatic vehicle tires, such that the weaving speed, particularly the withdrawal speed of the warp threads from the bobbins and the weight of the bobbins, have no negative influence, as, for example, an overstretching of the warp thread family during a machine start.

It is also an object of the invention to improve a weaving system for implementing the process in this respect.

These and other objects have been achieved according to the present invention by providing process for controlling warp tension in a weaving system having a plurality of warp threads disposed on a plurality of rotatable, self-braking bobbins, said warp threads being pulled by a withdrawal roller through a feeding stand arranged between said bobbins and said withdrawal roller, said warp threads forming a warp thread family which defines a reference plane in said feeding stand during a normal withdrawal speed of said withdrawal roller, said process comprising the acts of: deflecting said warp thread family in a controlled manner into at least one defined position relative to said reference plane when said withdrawal roller is stopped or slowed from said normal withdrawal speed; and returning said warp thread family in a controlled manner from said at least one defined position to said reference plane when said withdrawal roller is returned to said normal withdrawal speed.

These and other objects have been achieved according to the present invention by providing a weaving system for making a woven fabric, comprising: a plurality of self-braking bobbins carrying respective warp threads; a withdrawal roller arranged to pull said warp threads from said bobbins; a feeding stand interposed between the bobbins and the withdrawal roller, said feeding stand guiding said warp threads to form a warp thread family defining a reference plane during a normal withdrawal speed of said withdrawal roller; a compensating shaft rotatably disposed at opposite axial ends on respective support elements, said compensating shaft being arranged to engage said warp thread family in said feeding stand; at least one adjusting unit operatively coupled to at least one of said support elements, said adjusting unit being controlled to move said compensating shaft out of a normal operating position in order to deflect said warp thread family from said reference plane into at least one defined position relative to the reference plane when said withdrawal roller is stopped or slowed from said normal withdrawal speed, and said adjusting unit being controlled to return said compensating shaft to said normal operating position in order to return said warp thread family from said at least one defined position to said reference plane when said withdrawal roller is returned to said normal withdrawal speed.

According to the invention, in the event of an interruption of the weaving process or during a weaving-technical operation, the warp thread family is deflected in a controlled manner into at least one defined position relative to a plane in which the thread family is guided through the feeding stand, in the sense of creating a warp reserve, and that, during a new start of the weaving process or at the end of a weaving-technical operation, the thread family is returned from the deflected position in a controlled manner into the above-mentioned plane.

According to the invention, a compensating shaft, which is connected with one support element on each axial and, respectively, is positioned in the weaving system in a separate device (feeding stand) existing between the mechanical weaving loom with the withdrawal roller and the bobbin creel, above the axis of rotation of two rollers which are arranged axially in parallel and spaced from one another and which may be rotatably disposed in the device.

A circumferential area of the compensating shaft may preferably be in contact with the warp thread family.

According to the invention, an adjusting unit is operatively coupled to each support element spaced from its axis of rotation situated in the separate feeding stand. The adjusting unit moves the compensating shaft, together with the warp thread family in the event of the occurrence of a weaving stop or when carrying out a complex, technical weaving operation (which requires a reduction in the withdrawal speed of the warp thread family from the bobbin creel), from a reference plane of the thread family or from a first position of the compensating shaft in a controlled manner into at least one second or third position within the feeding stand. The weaving process may be stopped for various reasons known in the art, for example due to a defect such as a torn woof thread or warp thread, which defect is determined by means of a thread guard and is signaled to the weaving loom control. The elimination of such a defect may take place automatically, at the conclusion of which the defect elimination is signaled to the weaving loom control, at which time the weaving process is re-started by a start signal from the weaving loom control. When the weaving loom is re-started, or returned from a reduced speed to normal operating speed at the end of a complex, technical weaving operation, the warp is returned in a controlled manner into the reference plane under the pull of the withdrawal roller of the weaving loom via the compensating shaft.

In order to control the deflection of the warp thread family (both causing and eliminating the deflection), a measuring device is assigned to at least one of the support elements within the separate feeding stand. For example, a path measuring device may be used as a measuring device in this context which interacts with at least one of the support elements. Alternatively or additionally, it is contemplated to integrate a load measuring cell in at least one of the rollers.

In the event that the roller is disposed in a rotating manner in the separate feeding stand, the measuring device may be a pressure gauge which senses the bearing forces of the roller and transmits them in a signal-transmitting manner to the central control system of the weaving system, which also takes place in the other cases when a measuring device is used.

The control system of the at least one adjusting unit will then, together with the corresponding warp tension measuring device, form an electric control circuit for appropriately and controllably causing and eliminating the deflection of the warp thread family.

The following advantages are achieved by the invention:

(a) compensation between the withdrawal speed of the warp thread family and the initial rotation of the thread bobbins in the starting phase of the mechanical weaving loom, which protects the warp thread family from overstretching in the starting phase;

(b) maintaining a corresponding warp tension in the warp thread family during the stopping phase of the weaving loom and at the end of technical weaving operations; and (c) maintaining an orderly thread family in every working phase of the weaving system.

Other objects, advantages and novel features of the present invention will become apparent from the following detailed description of the invention when considered in conjunction with the accompanying drawings.

DETAILED DESCRIPTION OF THE DRAWINGS

Figure 1:
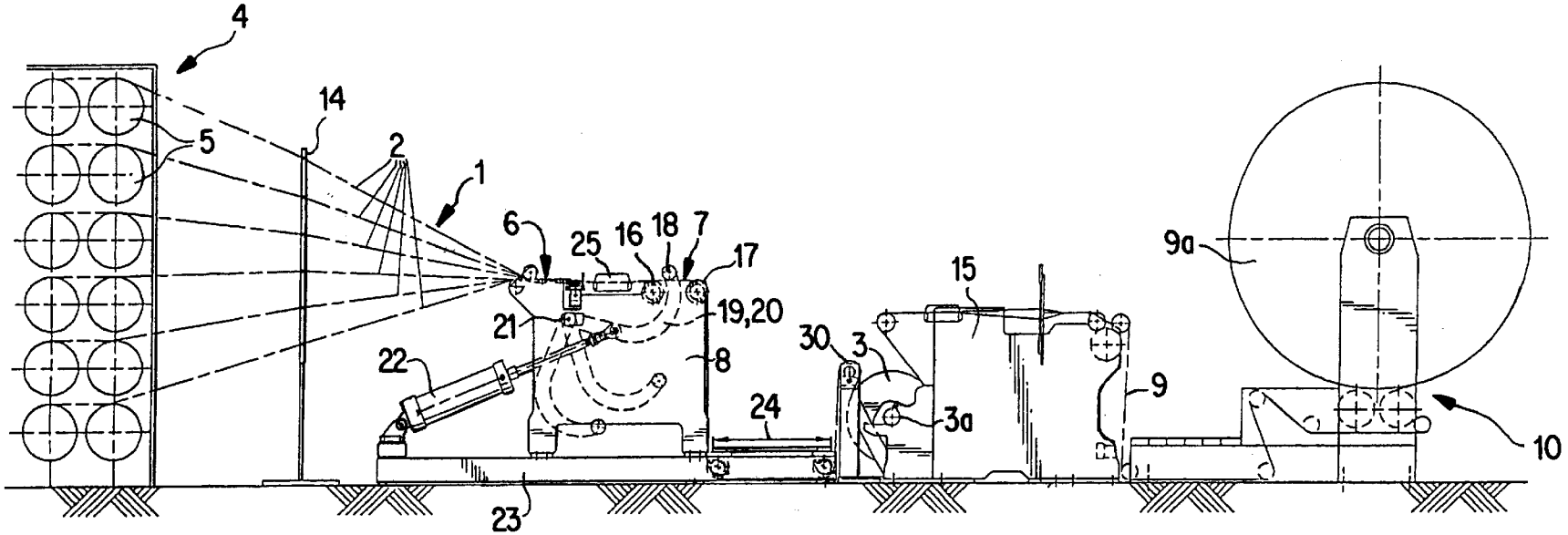
FIG. 1 is a schematic view of a weaving system for producing woven fabric, particularly cord wovens for pneumatic vehicle tires, according to a preferred embodiment of the present invention, which may be utilized to carry out the process according to a preferred embodiment of the present invention.

Referring to FIG. 1, the weaving system for producing woven fabrics particularly cord wovens for pneumatic vehicle tires, includes the following. At least one bobbin creel 4 is provided with a plurality of bobbins 5 arranged in a self-braking manner. The weaving system may optionally include a perforated board 14. A weaving loom 15 is arranged downstream of the bobbin creel, and has a withdrawal roller 3. A separate device 8, which can also be called a feeding stand, is interposed between the bobbin creel 4 and the weaving loom 15. In the feeding stand 8, a warp thread family 1 is guided in an orderly manner in a reference plane 7 formed by a thread guiding device 6 and two rollers 16, 17, which are arranged axially in parallel and spaced with respect to one another. The warp thread family 1 is monitored in a warp monitoring unit 25 and, between the rollers 16, 17, is held in a tensioned manner by a compensating shaft 18 which is disposed at each axial end on respective support elements 19, 20 with an axis of rotation 21. A wind-up device 10 for winding up the woven fabric 9 is arranged downstream of the weaving loom 15.

When fully wound, the bobbins 5 disposed in the bobbin creel 4 have a weight of several kilograms. The bobbins 5 are accommodated in the creel 4 rotationally movably disposed around their longitudinal axis such that the warp threads 2 can be radially withdrawn from the bobbin creel.

Since the warp threads 2 are guided through a perforated board 14 arranged behind the bobbin creel 4, the warp threads 2 are arranged in a orderly manner in a onelayer thread family 1, and can be fed to the separate device 8, the so-called feeding stand, mounted on the support stand 23.

On the inlet side of the feeding stand 8, in a reference plane 7, the warp thread family 1 travels through a thread guiding device 6 and subsequently through a warp monitoring unit 25 before it is pulled through between the rollers 16,17 and a movement-controlled compensating shaft 18 while the withdrawal roller 3 is rotating.

The support stand 23 is constructed to project in the direction of the weaving loom 15 such that space for a weaver's aisle 24 exists between the withdrawal roller 3 of the weaving loom 15 and the feeding stand 8.

Below the weaver's aisle 24, two deflecting rollers 28, 29 are rotatably disposed with their respective axes parallel and spaced from one another.

The warp thread family 1 leaving the feeding stand 8 via the roller 17 is guided around the deflecting rollers 28, 29 and, either directly or indirectly via another deflecting roller 30 positioned above the axis of rotation 3*a* of the withdrawal roller 3, reaches the withdrawal roller 3 of the weaving loom 15.

In this case, the indirect guiding of the warp thread family 1 has the advantage that the warp thread family 1 implements on the withdrawal roller 3 a slightly larger wind-around angle than would be possible without the deflecting roller 30. The larger wind-around angle has an advantageous effect on the withdrawal action of the withdrawal roller 3 with respect to the bobbins 5.

In a weaving loom 15 a woven fabric 9 is produced from the warp thread family 1 together with weft threads in a known forming process for wovens, which woven fabric 9, after leaving the weaving loom, is wound up via a wind-up device 10 to form a woven fabric roll 9*a*.

Figure 2:
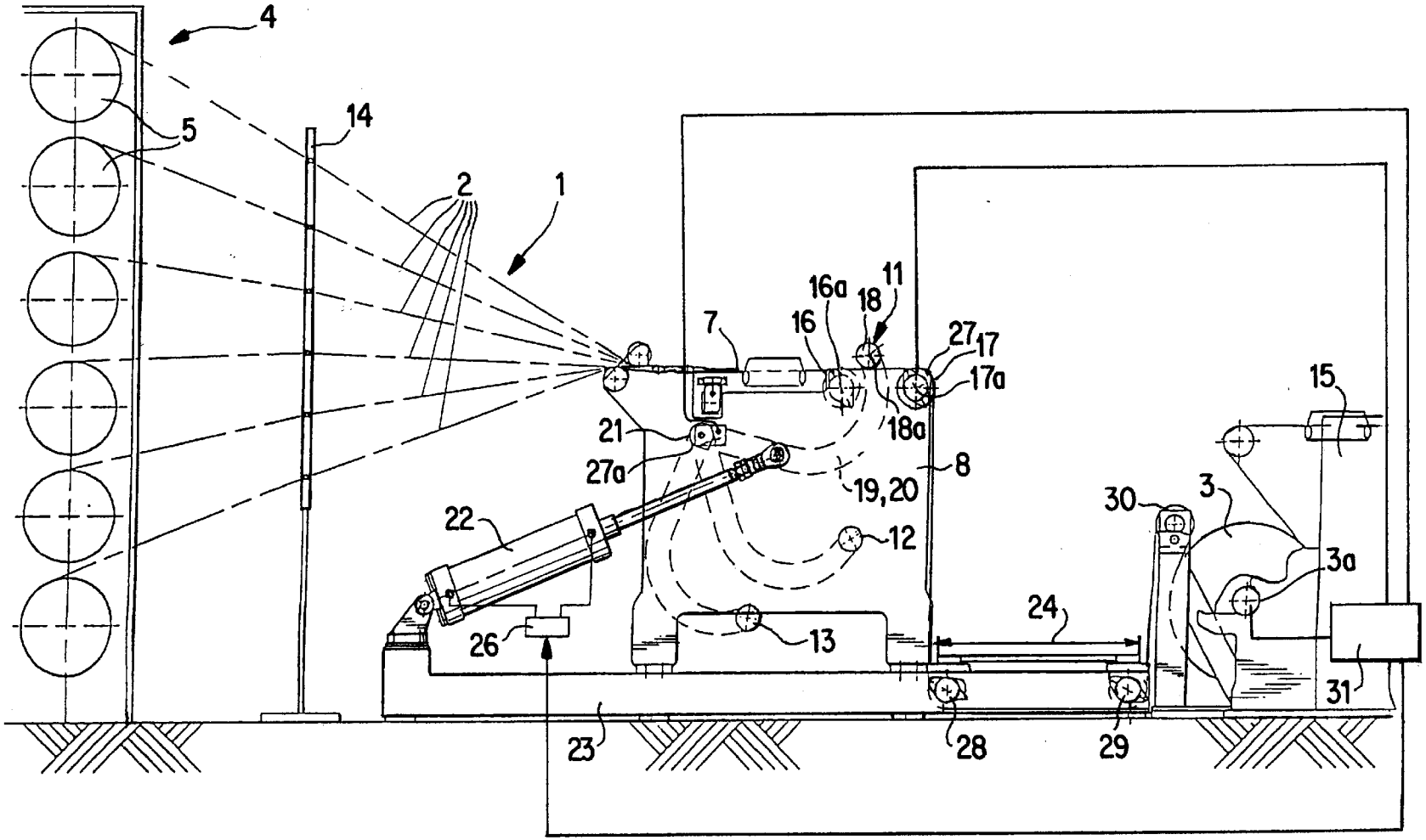
FIG. 2 is an enlarged view in the area of the separate feeding stand of FIG. 1.

According to FIG. 2, the feeding stand 8 includes a first support element 19 and a second support element 20, the support elements 19, 20 being arranged at opposite axial ends of the compensating shaft 18. Both support elements can be swivelled at their proximal ends about a common axis of rotation 21 and, on their distal ends, accommodate the compensating shaft 18 in a rotatable manner.

During the normal weaving process of the weaving loom 15, the axis of rotation 18*a* of the compensating shaft 18 is situated above the axes of rotation 16*a*, 17*a* of the rollers 16, 17 in a first position 11. In this case, the first position 11 corresponds approximately to the reference plane 7 in which the warp thread family 1 is pulled through the device 8.

At least one adjusting unit 22, spaced away from the axis of rotation 21, is operatively coupled to at least one of the support elements 19, 20 carrying the compensating shaft 18. The adjusting unit 22, as well as the feeding stand 8, are each connected with the support stand 23.

The adjusting unit 22 is connected with a control unit 26. As a function of a weaving stop, a technical weaving operation and a new start of the weaving process, the compensating shaft 18 is moved in a controlled manner from a first position 11 into a second position 12 or into a third position 13, or from these positions 12, 13 into position 11, via the controlled adjusting unit 22. Corresponding to a trailing length of the warp thread family 1 resulting from the weaving stop and thus from the interrupted withdrawal speed of the withdrawal roller 3 with which the warp thread family 1 is withdrawn from the bobbins 5, the warp thread family 1 is deflected in a controlled manner into the positions 12, 13 or, in the event of a new start of the weaving process, is returned in a controlled manner from these positions into the reference plane 7.

Operations of the withdrawal roller 3 and the weaving loom 15, including speed, are sensed and controlled by a weaving loom control 31. The control unit 26 and the drive for the withdrawal roller 3 are connected in a signal-transmitting manner with the weaving loom control 31. When the withdrawal roller 3/weaving loom 15 slow or stop, the weaving loom control 31 sends a corresponding signal to the control unit 26, which in turn controls the adjusting unit 22 to deflect the warp thread family 1 out of the reference plane 7 (for example into second position 12 or third position 13) to account for the reduced or interrupted withdrawal speed from the withdrawal roller 3. When the withdrawal roller 3/weaving loom 15 return to normal operating speed, the weaving loom control sends a corresponding signal to the control unit 26, which in turn controls the adjusting unit 22 to return the warp thread family 1 from the deflected position back into the reference plane 7.

During the controlled deflection and the controlled elimination of the deflection of the warp thread family 1, it may be advantageous to always hold the warp thread family 1 under a certain tensile strain. This tensile strain (or warp tension) may be sensed, for example, on the roller 17 with a suitable warp tension measuring device 27. The warp tension measuring device 27 is connected in a signal-transmitting manner with the weaving loom control 31. The measured tensile strain is used to control or regulate the deflection and the release operation of the warp thread family 1.

In order to detect the position of the compensating shaft 18, a path measuring device 27*a* is provided in the movement area, thus, between the first position 11 and the third position 13. The path measuring device 27*a*, like the warp tension measuring device 27, the control unit 26, and the drive of the withdrawal roller 3, is connected in a signal-transmitting manner with the weaving loom control 31.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Process for controlling warp tension in a weaving system having a plurality of warp threads disposed on a plurality of rotatable, self-braking bobbins, said warp threads being pulled by a withdrawal roller through a feeding stand arranged between said bobbins and said withdrawal roller, said warp threads forming a warp thread family which defines a reference plane in said feeding stand during a normal withdrawal speed of said withdrawal roller, said process comprising the acts of:

deflecting said warp thread family in a controlled manner into at least one defined position relative to said reference plane as a function of a stop signal from a weaving loom control when said withdrawal roller is stopped or slowed from said normal withdrawal speed; and returning said warp thread family in a controlled manner from said at least one defined position to said reference plane as a function of a start signal from said weaving loom control when said withdrawal roller is returned to said normal withdrawal speed.

2. Process according to claim 1, wherein said weaving system is used for manufacturing a cord woven for pneumatic vehicle tires.

3. Process according to claim 1, wherein said at least one defined position is a single position.

4. Process according to claim 1, wherein said deflecting act comprises deflecting said warp thread family into a second or a third defined position relative to said reference plane.

5. Process according to claim 1, wherein the warp thread family is under tension when in the reference plane as well as when in the at least one defined position.

6. Process according to claim 1, wherein said deflecting act is effected via a movable compensating shaft which engages said warp thread family.

7. Process according to claim 7, wherein the reference plane of the warp thread family corresponds to a first defined position of said compensating shaft.

8. Process for controlling warp tension in a weaving system having a plurality of warp threads disposed on a plurality of rotatable, self-braking bobbins, said warp threads being pulled by a withdrawal roller through a feeding stand arranged between said bobbins and said withdrawal roller, said warp threads forming a warp thread family which defines a reference plane in said feeding stand during a normal withdrawal speed of said withdrawal roller, said process comprising the acts of:

deflecting said warp thread family in a controlled manner into at least one defined position relative to said reference plane when said withdrawal roller is stopped or slowed from said normal withdrawal speed; and returning said warp thread family in a controlled manner from said at least one defined position to said reference plane when said withdrawal roller is returned to said normal withdrawal speed; and measuring a tensile strain of the warp thread family and using the measuring tensile strain for regulating the deflecting and the returning acts.

9. A weaving system for making a woven fabric, comprising:

a plurality of self-braking bobbins carrying respective warp threads;

a withdrawal roller arranged to pull said warp threads from said bobbins;

a feeding stand interposed between the bobbins and the withdrawal roller, said feeding stand guiding said warp threads to form a warp thread family defining a reference plane during a normal withdrawal speed of said withdrawal roller;

a compensating shaft rotatably disposed at opposite axial ends on respective support elements, said compensating shaft being arranged to engage said warp thread family in said feeding stand;

at least one adjusting unit operatively coupled to at least one of said support elements, a control device controlling said adjusting unit to move said compensating shaft out of a normal operating position in order to deflect said warp thread family from said reference plane into at least one defined position relative to the reference plane as a function of a stop signal from a weaving loom control when said withdrawal roller is stopped or slowed from said normal withdrawal speed, and said control device controlling said adjusting unit to return said compensating shaft to said normal operating position in order to return said warp thread family from said at least one defined position to said reference plane as a function of a start signal from said weaving loom control when said withdrawal roller is returned to said normal withdrawal speed.

10. Weaving system according to claim 9, wherein in said normal operating position, an axis of rotation of the compensating shaft is above the reference plane.

11. Weaving system according to claim 9, wherein in said at least one defined position, an axis of rotation of the compensating shaft is situated below the reference plane.

12. Weaving system according to claim 10, further comprising a common support stand which supports said feeding stand and said at least one adjusting unit.

13. Weaving system according to claim 12, wherein said support stand defines a space for a weaver's aisle between said withdrawal roller and said feeding stand.

14. Weaving system according to claim 13, wherein a first and a second deflecting roller are arranged below the weaver's aisle.

15. Weaving system according to claim 9, wherein said adjusting unit is a piston-cylinder unit controlled via said control device.

16. Weaving system according to claim 9, wherein said adjusting unit is driven by an electric motor controlled via said control device.

17. Weaving system for making a woven fabric, comprising:

a plurality of self-braking bobbins carrying respective warp threads;

a withdrawal roller arranged to pull said warp threads from said bobbins;

a feeding stand interposed between the bobbins and the withdrawal roller, said feeding stand guiding said warp threads to form a warp thread family defining a reference plane during normal withdrawal speed of said withdrawal roller;

the roller having a warp tension measuring device at least on an outlet side of the feeding stand;

a compensating shaft rotatable disposed at opposite axial ends on respective support elements, said compensating shaft being arranged to engage said warp thread family in said feeding stand;

at least one adjusting unit operatively coupled to at least one of said support elements, said adiusting unit being controlled to move said compensating shaft out of a normal operating position in order to deflect said warp thread family from said reference plane into at least one defined position relative to the reference plane when said withdrawal roller is stopped or slowed from said normal withdrawal speed, and said adjusting unit being controlled to return said compensating shaft to said normal operating position in order to return said warp thread family from said at least one defined position to said reference plane when said withdrawal roller is returned to said normal withdrawal speed.

18. Weaving system for making a woven fabric, comprising:

a plurality of self-braking bobbins carrying respective warp threads;

a withdrawal roller arranged to pull said warp threads from said bobbins;

a feeding stand interposed between the bobbins and the withdrawal roller, said feeding stand guiding said warp threads to form a warp thread family defining a reference plane during a normal withdrawal speed of said withdrawal roller;

a compensating shaft rotatably disposed at opposite axial ends on respective support elements, said compensating shaft being arranged to engage said ware thread family in said feeding stand;

a path measuring device assigned to at least one of the support elements for sensing a position thereof;

at least one adjusting unit operatively coupled to at least one of said support elements, said adiustinc unit being controlled to move said compensating shaft out of a normal operating position in order to deflect said wars thread family from said reference plane into at least one defined position relative to the reference plane when said withdrawal roller is stopped or slowed from said normal withdrawal speed, and said adjusting unit being controlled to return said compensating shaft to said normal operating position in order to return said warp thread family from said at least one defined position to said reference plane when said withdrawal roller is returned to said normal withdrawal speed.

19. Weaving system according to claim 17, wherein said control device and said warp tension measuring device form an electric control circuit.

* * * * *